US008256922B2

(12) United States Patent
Futami

(10) Patent No.: US 8,256,922 B2
(45) Date of Patent: Sep. 4, 2012

(54) LIGHTING DEVICE

(75) Inventor: Takashi Futami, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 390 days.

(21) Appl. No.: 12/487,627

(22) Filed: Jun. 18, 2009

(65) Prior Publication Data

US 2009/0316423 A1 Dec. 24, 2009

(30) Foreign Application Priority Data

Jun. 18, 2008 (JP) ..... 2008-159308

(51) Int. Cl.
*F21V 21/00* (2006.01)

(52) U.S. Cl. ..... 362/249.02; 362/249.01; 362/244; 362/245; 362/299

(58) Field of Classification Search ..... 362/249.01, 362/249.02, 276, 296.01, 297, 299, 308, 362/310, 311.12, 326, 327, 346, 350, 351, 362/475, 487, 507, 517, 518, 538, 539, 545, 362/800, 802, 244, 245
See application file for complete search history.

(56) References Cited

U.S. PATENT DOCUMENTS 7,568,824 B2 * 8/2009 Watanabe et al. ..... 362/538
2003/0198060 A1 10/2003 Ishida et al.
2006/0215415 A1 9/2006 Suzuki et al.
2008/0062706 A1 * 3/2008 Feldmeier ..... 362/459

FOREIGN PATENT DOCUMENTS

DE 4305633 A1 * 10/1993
JP 2003-317513 A 11/2003
JP 2006-269271 A 10/2006

* cited by examiner

*Primary Examiner* — Hargobind S Sawhney
(74) *Attorney, Agent, or Firm* — Kenealy Vaidya LLP

(57) ABSTRACT

A lighting device with a stable high light intensity can effectively dissipate heat generated by an LED so that the light emission efficiency does not deteriorate while the inside temperature distribution can be maintained in an even state. The lighting device can also be configured to prevent snow from adhering onto an outer lens by allowing an outer surface temperature of the lighting device to rise during actuation of the device. The lighting device can also be configured to improve light utilization efficiency. The lighting device can include a semiconductor light emitting device as a light source and can include structure(s) that guides the emission light to a projection lens. The semiconductor light emitting device can be configured to emit light in a reverse or opposed direction with respect to an illumination direction for the lighting device. A projection lens can be disposed in front of the semiconductor light emitting device. An elliptic reflector can be configured to reflect light from the semiconductor light emitting device and to direct the light to the projection lens. A lens holder can be made of metal and the semiconductor light emitting device and the projection lens can be disposed on the lens holder.

19 Claims, 6 Drawing Sheets

LIGHTING DEVICE

This application claims the priority benefit under 35 U.S.C. §119 of Japanese Patent Application No. 2008-159308 filed on Jun. 18, 2008, which is hereby incorporated in its entirety by reference.

TECHNICAL FIELD

The presently disclosed subject matter relates to a lighting device including a semiconductor light emitting device (such as an LED) as a light source, and in particular, to a lighting device for use in a vehicle, that takes certain measures against heat generated by such a semiconductor light emitting device.

BACKGROUND ART

Conventional vehicle lights have employed a high intensity discharge lamp (HID lamp with approximately 3200 lm) and a halogen bulb (with 1000 to 1500 lm) as a light source. In order to reduce the power consumption and miniaturize the entire body size of the light, a projector type vehicle light that employs a semiconductor light emitting device as a light source is proposed in, for example, Japanese Patent Application Laid-Open No. 2003-317513.

Consider the case where an LED is employed as a light source semiconductor light emitting device. Such an LED has a luminous intensity as low as approximately 400 lm. Accordingly, a plurality of lamp units each including an LED are typically combined to ensure a desired light intensity and to improve the light distribution performance. When the vehicle light is of a projector type, the light emitted from the semiconductor light emitting device is collected and reflected by an elliptic reflector towards a projection lens to form a light distribution pattern suitable for, for example, a vehicle headlight. When a plurality of LED lamp units are combined within a limited space for installing such a headlight, a projection lens having a corresponding size cannot be installed within such a limited space due to the size, posing a problem in which the light utilization efficiency deteriorates to lower the light intensity.

In order to increase the light intensity at the center of the light distribution pattern, it would be conceivable to incline the light source so that the light illumination direction of the light source is adjusted with respect to the position of the reflector that is disposed on or near the center axis of a projection lens. In this case, it would be difficult and sometimes impossible to obtain sufficient light intensity. Accordingly, the application of a large current to a semiconductor light emitting device can be conceivable in order to increase the light intensity sufficient for a vehicle headlight. In this case, however, heat generation can be significant, and in some cases the semiconductor light emitting device can emit only a smaller amount of light than that in a normal condition or cannot be lit depending on the performance of the device due to the heat generation. In addition, the high current high heat environment may shorten the service life of the semiconductor light emitting device. To take a countermeasure against these problems, effective cooling of the semiconductor light emitting device to be supplied with a large current has been examined. One example of such a countermeasure is to provide a heat dissipation member (for example, a heat sink) to a semiconductor light emitting device (see, for example, Japanese Patent Application Laid-Open No. 2006-269271).

SUMMARY

The projector type vehicle lights disclosed in Japanese Patent Application Laid-Open Nos. 2003-317513 and 2006-269271 include a reflector disposed behind a projection lens and a semiconductor light emitting device arranged within the inside space of the reflector. This type of vehicle light is typically positioned in front of an engine room and, accordingly, can be affected by heat from the engine room. Due to the heat from the engine room, the heat generated by the semiconductor light emitting device cannot be effectively and sufficiently dissipated and accordingly, the semiconductor light emitting device itself cannot be sufficiently cooled. Even when partly cooled, the inside of the vehicle light may have an uneven temperature distribution. This may cause a problem in which the inside of an outer lens can be fogged due to moisture build up or dew. When the semiconductor light emitting device is an LED, the light emitted from the LED may contain a very small amount of an infrared ray component, meaning that the irradiated surface of the projection lens cannot be heated. As the surface temperature cannot rise, when snow adheres to the surface of the outer lens, it may remain as it is and be difficult to remove.

The presently disclosed subject matter was devised in view of these and other features, characteristics, and problems, and in association with the conventional art. According to an aspect of the presently disclosed subject matter a lighting device can be provided, such as a vehicle light, with a stable high light intensity. The lighting device can effectively dissipate heat generated by a semiconductor light emitting device which serves as a light source so that the light emission efficiency of the semiconductor light emitting device is prevented from deterioration, while the inside temperature distribution can be evened or equalized throughout the device. Furthermore, the lighting device can prevent snow from adhering onto an outer lens by causing the lens' surface temperature to rise. Still further, the lighting device can improve the utilization efficiency of light emitted from the semiconductor light emitting device.

The presently disclosed subject matter includes various technical means and structures for addressing the above concerns, features, and problems.

According to a first aspect of the presently disclosed subject matter, a lighting device having an illumination direction can include: a lens holder made of a metal material; a semiconductor light emitting device disposed in the lens holder so as to emit light in a reverse direction with respect to the illumination direction; at least one projection lens disposed in the lens holder on the side of the illumination direction with respect to the semiconductor light emitting device; and an elliptic reflector disposed in the direction in which the semiconductor light emitting device emits light so as to reflect light from the semiconductor light emitting device to direct the light to the projection lens so that the lighting device illuminates outside.

In the above lighting device, the lens holder can have an outer peripheral surface on which a heat dissipation member (for example, heat dissipation fin) is integrally formed therewith.

The above lighting device can further include a parabolic reflector disposed in the direction in which the semiconductor light emitting device emits light so as to reflect the light that cannot be reflected by the elliptic reflector out of the light emitted from the semiconductor light emitting device.

The above lighting device can further include a light-shielding member (for example, a light-shielding shutter) provided to the lens holder, the light-shielding member configured to form a cut-off line in a light distribution pattern near a focus of the projection lens.

In the above lighting device, the projection lens can be composed of a plurality of convex lenses integrally formed, and the elliptic reflector can be composed of a plurality of elliptic reflectors being integrally formed and being provided in the same number as the number of the convex lenses.

In the above lighting device, the number of the convex lenses can be two that are arranged side by side in the vertical direction when the lighting device is installed in a vehicle, and the number of the elliptic reflectors can be two that are arranged side by side in the vertical direction.

In the above lighting device, the parabolic reflector can be disposed on either side of an area where the two elliptic reflectors are integrally formed and connected to each other.

The above lighting device can be used for a vehicle.

The lighting device can be suitably used for efficiently dissipating heat generated by the semiconductor light emitting device to which a large current must be supplied. This configuration can stably maintain a high light intensity without the light emission efficiency of the device deteriorating. Furthermore, the device's service lifetime can be extended. As the inside temperature distribution can be made more even, the fogging of the inner surface of the outer lens can be prevented. Furthermore, as the temperature of the outer lens can be caused to rise, snow adherence on the outer lens can be simultaneously prevented.

In the presently disclosed subject matter, the parabolic reflector can reflect light that cannot be reflected by the elliptic reflector out of the light emitted from the semiconductor light emitting device. This configuration can improve the light utilization efficiency to provide a vehicle light with a high light intensity. As the lens holder can include a heat dissipation member or a heat sink (heat dissipation fin) according to the presently disclosed subject matter, the heat sink can advantageously impart an aesthetic appearance to the lighting device.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
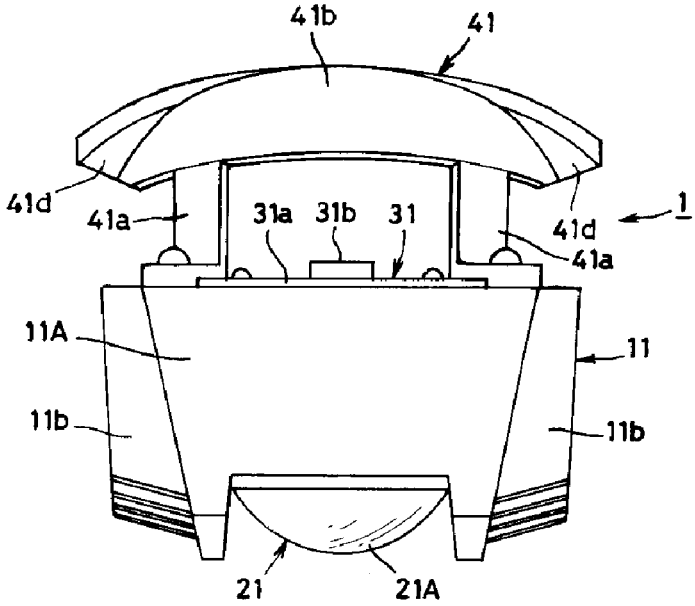
FIG. 1 is a plan view illustrating, as a first exemplary embodiment, a lighting device, or a vehicle light, made in accordance with principles of the presently disclosed subject matter.
Figure 2:
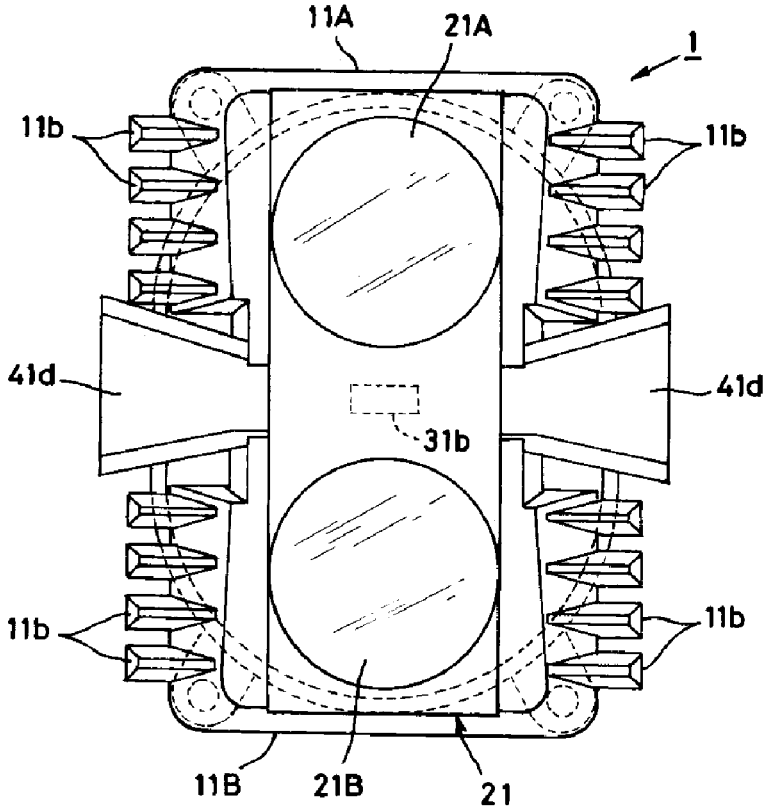
FIG. 2 is a front view illustrating the lighting device of FIG. 1.
Figure 3:
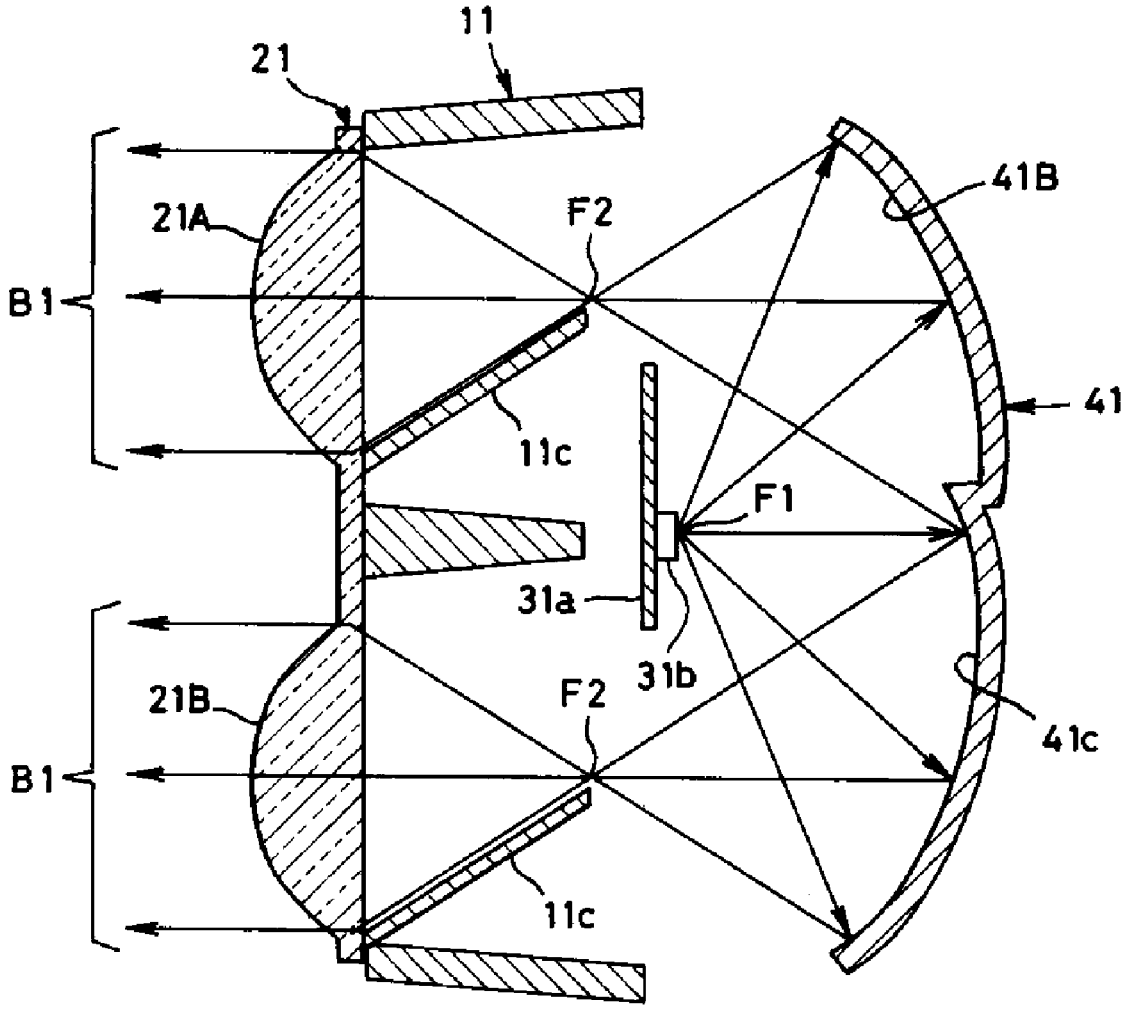
FIG. 3 is a schematic cross-sectional view illustrating the lighting device of FIG. 1.
Figure 4:
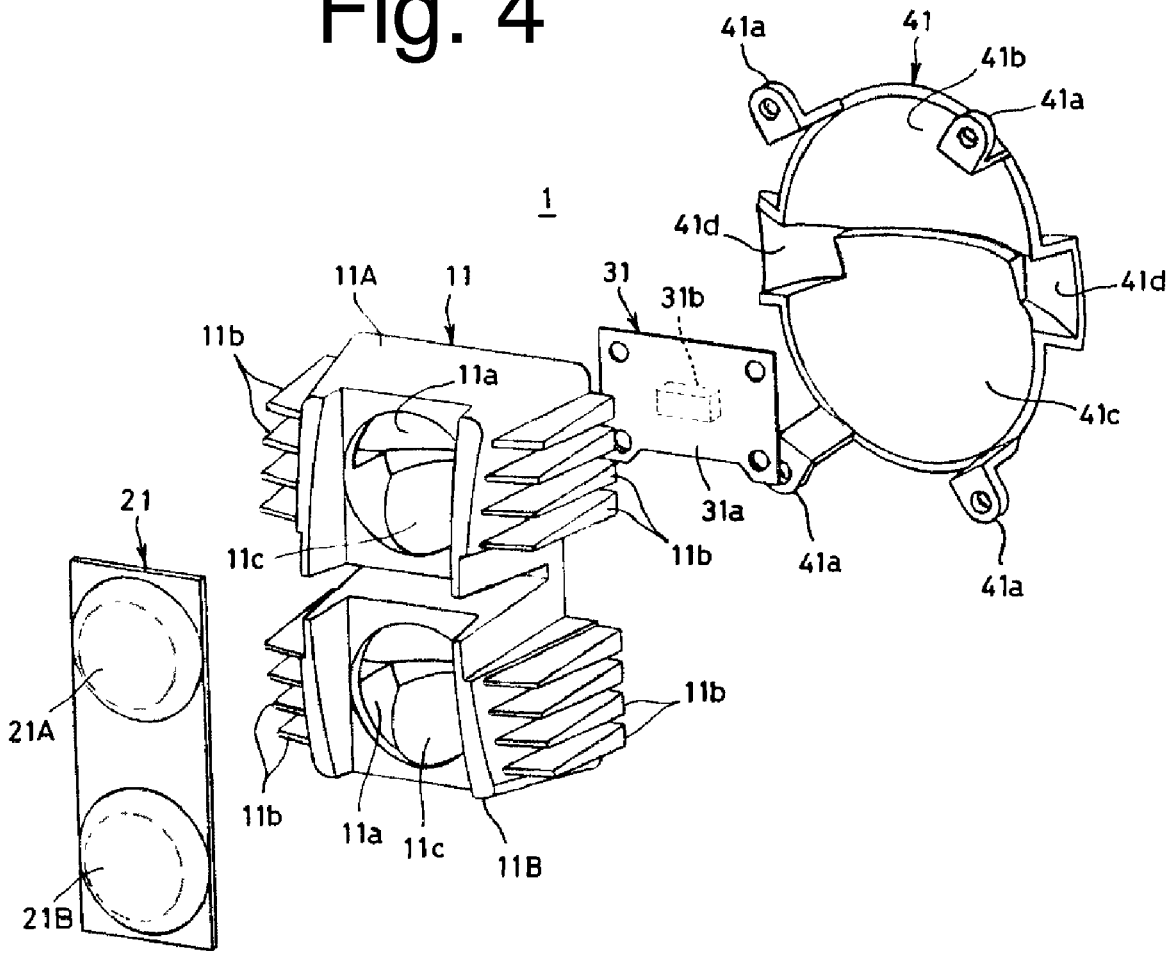
FIG. 4 is an exploded perspective view illustrating the lighting device of FIG. 1.

A description will now be made below with respect to lighting devices of the presently disclosed subject matter with reference to the accompanying drawings and in accordance with exemplary embodiments. In the following exemplary embodiments, the semiconductor light emitting device for use in the lighting device is described as an LED and the lighting device is a projector type vehicle light, as an example. It should be understood, however, that the presently disclosed subject matter is not limited to these concrete examples The first exemplary embodiment of the presently disclosed subject matter is a twin beam type vehicle light 1. FIG. 1 is a plan view of the vehicle light 1, FIG. 2 is a front view thereof, FIG. 3 is a schematic cross-sectional view thereof, and FIG. 4 is an exploded perspective view thereof. The vehicle light 1 can include a lens holder 11, a lens unit 21, a light source unit 31, and an elliptic reflector 41.

The lens holder 11 can be a main component of the vehicle light 1. The lens holder 11 can include an upper lens holder 11A (see FIGS. 1 and 4) and a lower lens holder 11B (see FIG. 4) which can both be integrally formed with each other. The lens holder 11 can be formed of a metal material such as aluminum, light alloys, or the like by casting or forging.

A projection window 11*a* (see FIG. 4) can be formed on the front side of each of the upper lens holder 11A and the lower lens holder 11B so as to penetrate the lens holder 11 to the rear side thereof. A heat sink 11*b* (heat dissipation member) can be formed on the peripheral side of the lens holder 11. An inner space can be formed in the upper lens holder 11A and the lower lens holder 11B extending from the projection window 11*a* to the rear side thereof. A light shielding shutter 11*c* (see FIGS. 3 and 4) may be disposed in the inner space, if necessary, near the focus of the projection lens in order to form a cutoff line in a light distribution pattern such as a low beam light distribution pattern.

The lens unit 21 can be mounted on the lens holder 11. The lens unit 21 can include an upper convex lens 21A and a lower convex lens 21B as a projection lens, which can be integrally formed with each other. The lens unit 21 can be formed of a resin material such as acrylic resin, or a glass material, or other known lens material(s).

The lens unit 21 can be fixed to the lens holder 11 by appropriate means, such as an adhesive. Specifically, the upper convex lens 21A and the lower convex lens 21B can be disposed on the lens holder 11 such that they coincide with the positions of the upper lens holder 11A and the lower lens holder 11B, respectively, and then the lens unit 21 can be fixed by an adhesive or other attachment structure or material. It should be noted that the upper convex lens 21A and the lower convex lens 21B may be convex lenses separately molded although the illustrated lenses are integrally formed to provide the integral lens unit 21. When they are separate lenses, they can be separately disposed onto corresponding projection windows of the lens holder 11 for fixing.

The light source unit 31 can include a substrate 31*a* having a superior heat conductivity, and an LED 31*b* secured on the substrate 31*a*. In the present exemplary embodiment, the LED 31*b* can be composed of a plurality of LED elements arrayed in line and integrally formed as a single chip. The light source unit 31 can be fixed by securing the substrate 31*a* to the lens holder 11 by means of screwing or by other known attachment structure or material. In this instance, the light source unit 31 can be configured such that the center of the LED 31*b* can be positioned at or near the center between the optical axes of the upper and lower convex lenses 21A and 21B. When the light source unit 31 is placed in position in the lens holder 11 and supplied with an electrical current, the LED 31*b* can emit light in a direction opposite to the illumination direction, or in the rearward direction, of the lighting device.

The elliptic reflector 41 can include a first elliptic reflection surface 41*b* and a second elliptic reflection surface 41*c*, and supports 41*a*. The first elliptic reflection surface 41*b* can reflect the light emitted from the LED 31*b* towards the upper lens holder 11A. The second elliptic reflection surface 41*c* can reflect the light emitted from the LED 31*b* towards the lower lens holder 11B. The elliptic reflector 41 can be secured to the lens holder 11 by screwing the supports 41*a* to the lens holder 11. Accordingly, the light emitted from the LED 31*b* can be reflected by the elliptic reflector 41 disposed behind the LED 31*b* towards the lens unit 21 positioned in the illumination direction of the lighting device.

The first elliptic reflection surface 41*b* and the second elliptic reflection surface 41*c* each have a first focus F1 and a second focus F2. When the elliptic reflector 41 is installed in the lighting device, the first foci F1 of the first and second elliptic reflection surfaces 41*b* and 41*c* may be disposed on or near the light emission surface of the LED 31*b*. Furthermore, the second focus F2 of the first elliptic reflection surface 41*b* may be disposed on or near the focus of the upper convex lens 21A while the second focus F2 of the second elliptic reflection surface 41*c* may be disposed on or near the focus of the lower convex lens 21B. As a result, the elliptic reflector 41 can cover over the LED 31*b* from its front surface as if it functions as an umbrella. Accordingly, the angular range of approximately 140° from the vertical direction that is an effective range of the light surface-emitted from the LED can act as a reflection range, so that the reflection of the emitted light can be achieved with high efficiency. It should be noted that the light distribution pattern can be varied by shifting the second foci F2 in a front-to-rear direction or right-to-left direction as shown in FIG. 3 so as to obtain a wider angle of illumination through the upper and lower convex lenses 21A and 21B.

In the vehicle light 1 according to the first exemplary embodiment as described above, the light emitted from the LED 31*b* may widen in a transverse direction. In this case, however, all of the light emitted from the LED 31*b* may not be reflected only by the elliptic reflector 41. Accordingly, the vehicle light 1 of the first exemplary embodiment can further include parabolic reflectors 41*d* on either side of the elliptic reflector 41.

Figure 5:
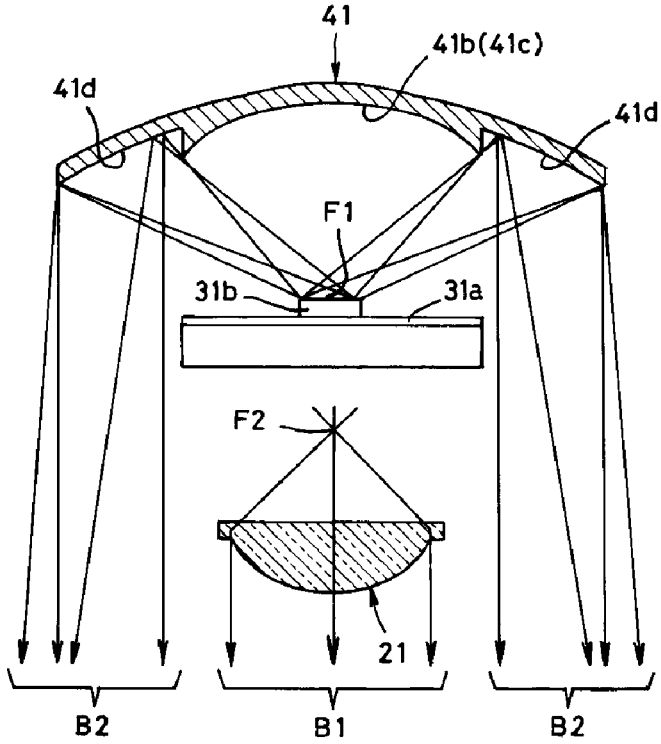
FIG. 5 is a schematic view illustrating a lighting action of the lighting device of FIG. 1.

This parabolic reflector 41*d* can be a revolved parabolic reflection surface or a free-curved reflection surface for obtaining reflected patterns widening in a transverse direction. The parabolic reflector 41*d* can have a focus on or near the light emission surface of the LED 31*b*. The parabolic reflector 41*d* can also be formed based on a parabolic surface, and accordingly, it does not require a particular projection lens in front of the reflector as shown in FIG. 2. The main illumination light B1 reflected and directed by the elliptic reflector 41, as shown in FIG. 5, can be emitted through the upper and lower convex lenses 21A and 21B whereas the auxiliary illumination light B2 reflected by the parabolic reflectors 41*d* can be emitted directly to the outside without passing through a projection lens. This configuration can improve the light utilization efficiency as well as the illumination efficiency.

In the vehicle light 1 of the first exemplary embodiment as described above, the heat generated by the LED 31*b* can be transmitted from the substrate 31*a* to the lens holder 11 directly. Then, the heat can be dissipated to the outside by the heat sink 11*b* provided on the lens holder 11 as well as via the lens holder 11 itself. This configuration can prevent the light emission efficiency from deteriorating while improving the cooling effect for the LED 31*b*. As the temperature of the lens holder 11 can be increased, the fogging of the inner surface of an outer lens (not shown) can be prevented. Furthermore, as the temperature of the outer lens can be caused to rise, snow adherence on the outer lens can also be prevented.

Figure 6:
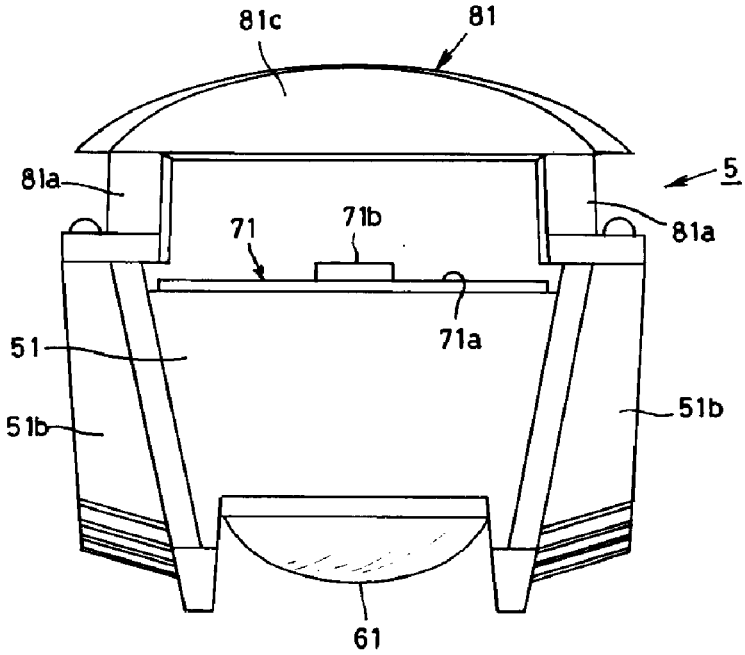
FIG. 6 is a plan view illustrating, as a second exemplary embodiment, a lighting device, or a vehicle light, made in accordance with principles of the presently disclosed subject matter.
Figure 7:
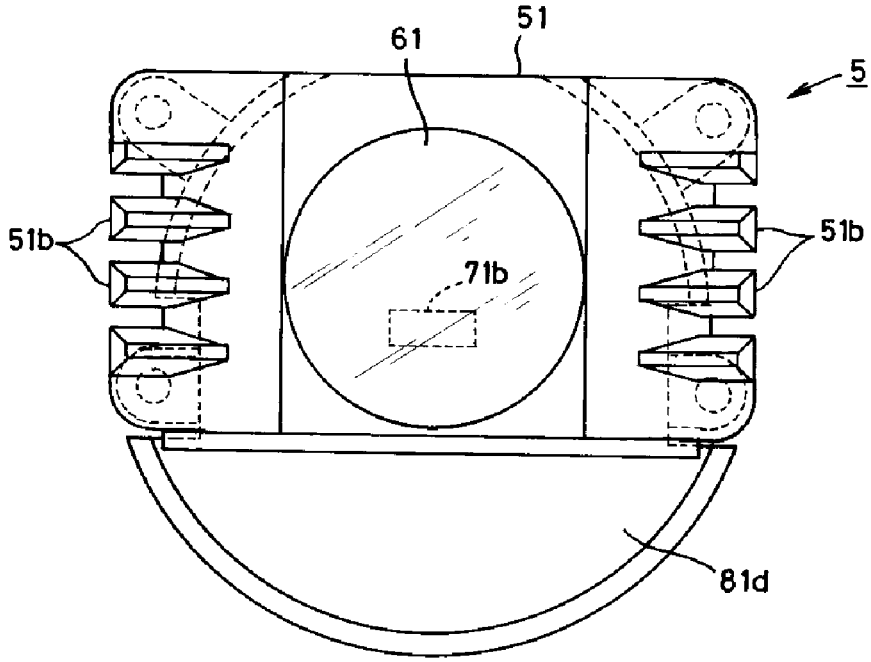
FIG. 7 is a front view illustrating the lighting device of FIG. 6.
Figure 8:
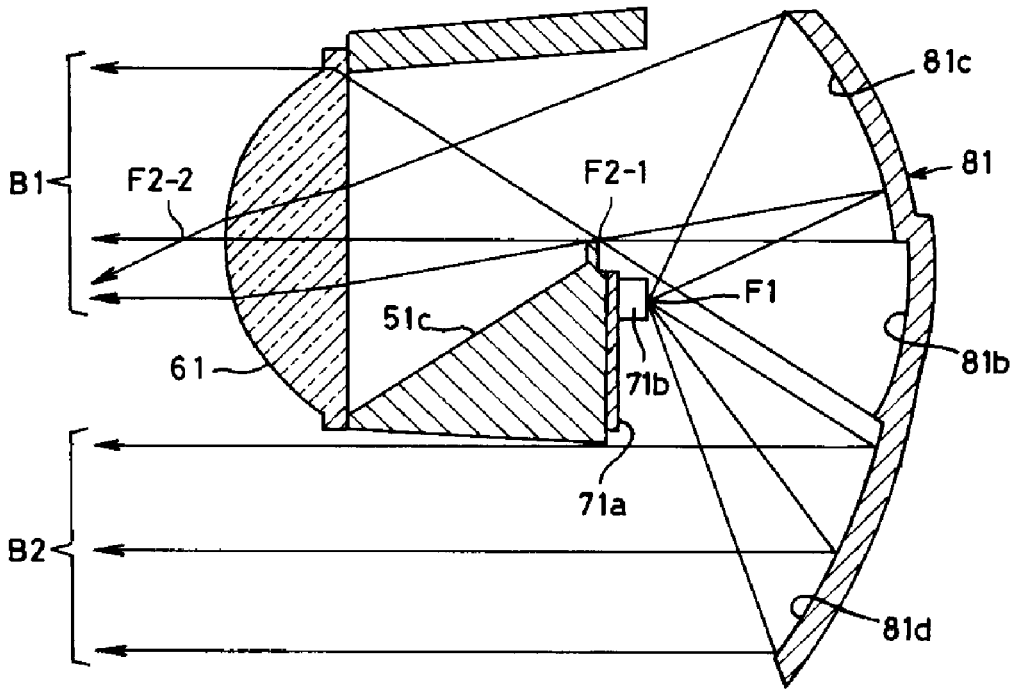
FIG. 8 is a schematic cross-sectional view illustrating the lighting device of FIG. 6.
Figure 9:
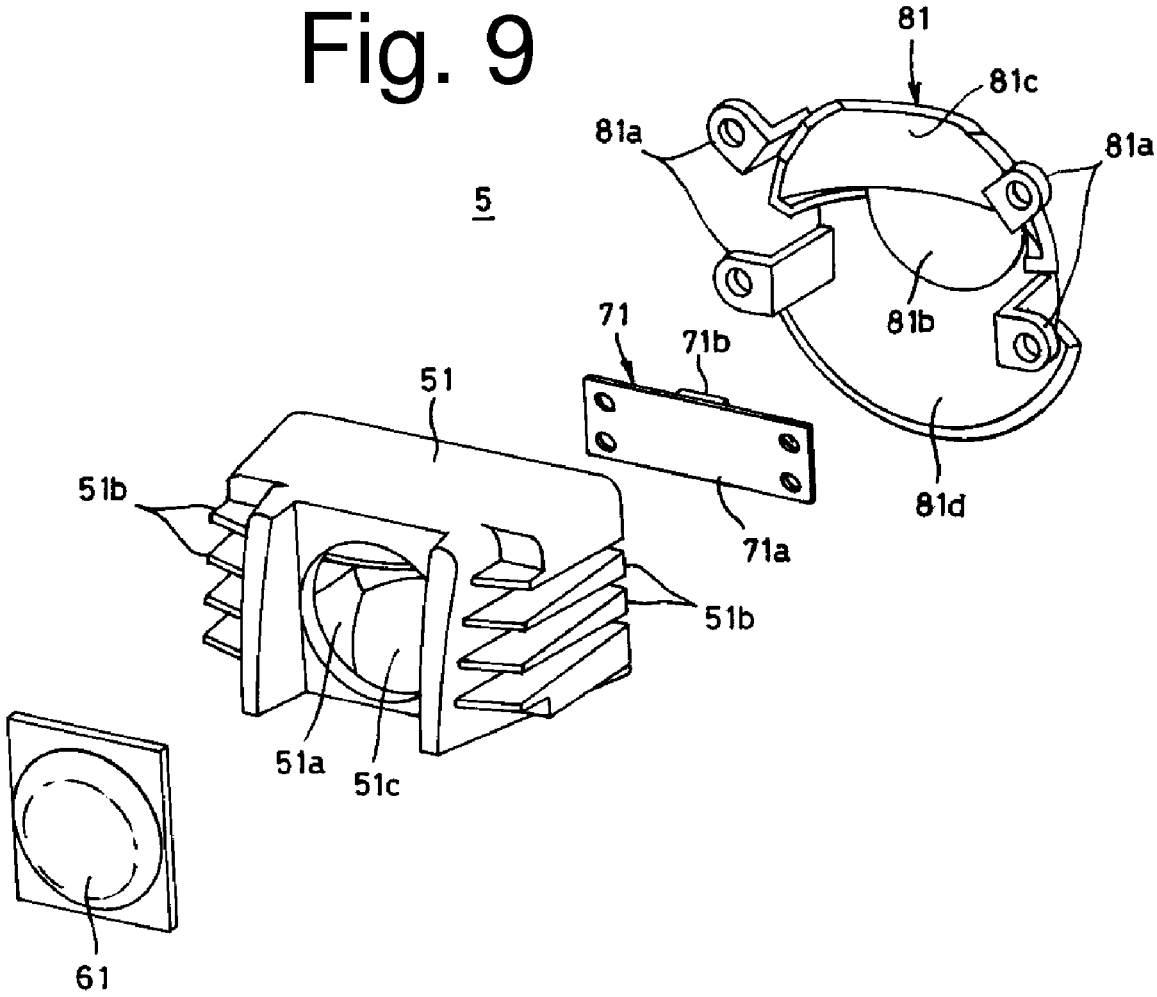
FIG. 9 is an exploded perspective view illustrating the lighting device of FIG. 6.

The second exemplary embodiment of the presently disclosed subject matter is a single beam type vehicle light 5. FIG. 6 is a plan view of the vehicle light 5, FIG. 7 is a front view thereof, FIG. 8 is a schematic cross-sectional view thereof, and FIG. 9 is an exploded perspective view thereof. The vehicle light 5 of the present exemplary embodiment can include a lens holder 51, a projection lens 61, a light source unit 71, and an elliptic reflector 81.

The lens holder 51 can be a main component of the vehicle light 5. The lens holder 51 can be formed of a metal material such as aluminum, light alloys, or the like by casting or forging as in the first exemplary embodiment.

A projection window 51*a* (see FIG. 9) can be formed on the front side of the lens holder 51 so as to penetrate the lens holder 51 to the rear side thereof. A heat sink 51*b* can be formed on the peripheral side of the lens holder 51. An inner space can be formed in the lens holder 51 extending from the projection window 51*a* to the rear side thereof. A light shielding shutter 51*c* may be disposed in the inner space, if necessary, near the focus of the projection lens in order to form a cutoff line in a light distribution pattern such as a low beam light distribution pattern.

A convex lens serving as the projection lens 61 can be mounted on the lens holder 51. The convex lens 61 can be formed of a resin material such as acrylic resin, or a glass material, or other known lens material. The convex lens 61 can be disposed on the lens holder 51 so that it coincides with the position of the projection window 51*a* of the lens holder 51, and then the convex lens 61 can be fixed by an adhesive or other attachment structure or material.

The light source unit 71 can include a substrate 71*a* having a superior heat conductivity, and an LED 71*b* secured on the substrate 71*a*. In the present exemplary embodiment, the LED 71*b* can be composed of a plurality of LED elements arrayed in line and integrally formed as a single chip. The light source unit 71 can be fixed by securing the substrate 71*a* to the lens holder 51 by means of screwing or by other known attachment structure or material. In this instance, the light source unit 71 can be configured such that the center of the LED 71*b* can be positioned at or near (or below) the lower end of the convex lens 61. When the light source unit 71 is placed in position in the lens holder 51 and is supplied with an electrical current, the LED 71*b* can emit light in a direction opposite the illumination direction, or in a rearward direction, of the lighting device.

The elliptic reflector 81 can include a first elliptic reflection surface 81*b* and a second elliptic reflection surface 81*c*, and supports 81*a*. The first and second elliptic reflection surfaces 81*b* and 81*c* can reflect the light emitted from the LED 71*b* towards the lens holder 51. The elliptic reflector 81 can be secured to the lens holder 51 by screwing the supports 81*a* to the lens holder 51. Accordingly, the light emitted from the LED 71*b* can be reflected by the elliptic reflector 81 disposed behind the LED 71*b* towards the convex lens 61 positioned in the illumination direction of the lighting device with respect to the LED 71*b*.

The first elliptic reflection surface 81*b* and the second elliptic reflection surface 81*c* each have a first focus F1 and a second focus F2-1 or F2-2. When the elliptic reflector 81 is installed in the lighting device 5, the first foci F1 of the first and second elliptic reflection surfaces 81*b* and 81*c* may be disposed on or near the light emission surface of the LED 71*b*. Furthermore, the second focus F2-1 of the first elliptic reflection surface 81*b* may be disposed on or near the focus of the convex lens 61 while the second focus F2 of the second elliptic reflection surface 81*c* may be disposed in front of the convex lens 61.

As a result, the elliptic reflector 81 can cover over the LED 71*b* from its front surface as if it functions as an umbrella. This configuration can increase the light utilization efficiency. It should be noted that the light distribution pattern can be varied by shifting the respective second foci F2-1 and F2-2 in a front-to-rear direction or right-to-left direction as viewed in FIG. 8 so as to obtain a wider angle of illumination through the convex lens 61.

In the vehicle light 5 according to the second exemplary embodiment as configured above, the light emitted from the LED 71*b*, in particular, emitted downward, may not be reflected only by the elliptic reflector 81. Accordingly, the vehicle light 5 of the second exemplary embodiment can include a parabolic reflector 81*d* on the lower side of the elliptic reflector 81.

The parabolic reflector 81*d* can be a revolved parabolic reflection surface or a free-curved reflection surface for obtaining reflected patterns widening in a transverse direction. The parabolic reflector 81*d* can have a focus on or near the light emission surface of the LED 71*b*. The main illumination light B1 reflected and directed by the elliptic reflector 81, as shown in FIG. 8, can be emitted through the convex lens 61 whereas the auxiliary illumination light B2 reflected by the parabolic reflector 81*d* can be emitted directly to the outside without passing through a projection lens. Accordingly, the angular range of approximately 140° from the vertical direction that is an effective range of the light surface-emitted from the LED can act as a reflection range, so that the reflection of the emitted light can be achieved with high efficiency. In the vehicle light 5 of the second exemplary embodiment as configured above, the heat generated by the LED 71*b* can be transmitted from the substrate 71*a* directly to the lens holder 51. Then, the heat can be dissipated to the outside by the heat sink 51*b* provided on the lens holder 51 as well as by the lens holder 51 itself. This configuration can prevent the light emission efficiency from deteriorating while improving the cooling effect for the LED 71*b*. As the temperature of the lens holder 51 is increased, the fogging of the inner surface of an outer lens can be prevented. Furthermore, as the temperature of the outer lens rises, snow adherence on the outer lens can also be prevented.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lighting device configured to emit light in an illumination direction, the lighting device comprising:

a lens holder made of a metal material;

a semiconductor light emitting device and disposed adjacent the lens holder so as to emit light in a reverse light emitting direction opposite the illumination direction;

at least one projection lens disposed adjacent the lens holder and spaced a distance in the illumination direction from the semiconductor light emitting device;

an elliptic reflector spaced a second distance in the reverse light emitting direction from the semiconductor light emitting device so as to reflect light emitted from the semiconductor light emitting device, and the elliptic reflector being configured to direct light received from the semiconductor light emitting device to the projection lens so that the lighting device emits light; and a parabolic reflector disposed in the reverse light emitting direction from the semiconductor light emitting device so as to reflect light emitted from the semiconductor light emitting device that is not reflected by the elliptic reflector.

2. The lighting device according to claim 1, wherein the lens holder has an outer peripheral surface on which a heat dissipation member is integrally formed.

3. The lighting device according to claim 2, further comprising a parabolic reflector disposed in the reverse light emitting direction from the semiconductor light emitting device so as to reflect light emitted from the semiconductor light emitting device that is not reflected by the elliptic reflector.

4. The lighting device according to claim 3, further comprising a light-shielding member located adjacent the lens holder, the light-shielding member configured to form a cut-off line in a light distribution pattern near a focus of the projection lens.

5. The lighting device according to claim 4, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

6. The lighting device according to claim 3, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

7. The lighting device according to claim 2, further comprising a light-shielding member located adjacent the lens holder, the light-shielding member configured to form a cut-off line in a light distribution pattern near a focus of the projection lens.

8. The lighting device according to claim 7, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

9. The lighting device according to claim 2, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

10. The lighting device according to claim 9, wherein the number of convex lenses is two and the two convex lenses are arranged side by side in a vertical direction when the lighting device is installed in a vehicle, and the number of elliptic reflectors is two and the two elliptic reflectors are arranged side by side in the vertical direction.

11. The lighting device according to claim 10, wherein a parabolic reflector is disposed on either side of the two elliptic reflectors and at a location where the two elliptic reflectors are integrally formed and connected to each other.

12. The lighting device according to claim 1, further comprising a light-shielding member located adjacent the lens holder, the light-shielding member configured to form a cut-off line in a light distribution pattern near a focus of the projection lens.

13. The lighting device according to claim 12, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

14. The lighting device according to claim 13, wherein the number of convex lenses is two and the two convex lenses are arranged side by side in a vertical direction when the lighting device is installed in a vehicle, and the number of elliptic reflectors is two and the two elliptic reflectors are arranged side by side in the vertical direction.

15. The lighting device according to claim 14, wherein a parabolic reflector is disposed on either side of the two elliptic reflectors and at a location where the two elliptic reflectors are integrally formed and connected to each other.

16. The lighting device according to claim 1, wherein the projection lens is composed of a plurality of integrally formed convex lenses, and the elliptic reflector is composed of a plurality of integrally formed elliptic reflectors, and the plurality of elliptic reflectors are provided in equal number as the number of the convex lenses.

17. The lighting device according to claim 16, wherein the number of convex lenses is two and the two convex lenses are arranged side by side in a vertical direction when the lighting device is installed in a vehicle, and the number of elliptic reflectors is two and the two elliptic reflectors are arranged side by side in the vertical direction.

18. The lighting device according to claim 17, wherein a parabolic reflector is disposed on either side of the two elliptic reflectors and at a location where the two elliptic reflectors are integrally formed and connected to each other.

19. The lighting device according to claim 1, wherein the lighting device is configured as a vehicle light.

* * * * *